United States Patent [19]

Fielding et al.

[11] Patent Number: 4,584,822

[45] Date of Patent: Apr. 29, 1986

[54] METHOD OF PACKING OBJECTS AND PACKING THEREFOR

[75] Inventors: Alfred W. Fielding, Allendale, N.J.; George T. Bertram, Sandy Hook, Conn.; Semyon Krislav, Stamford, Conn.; Joel Askinazi, Trumbull, Conn.

[73] Assignee: Sealed Air Corporation, Saddle Brook, N.J.

[21] Appl. No.: 587,182

[22] Filed: Mar. 7, 1984

[51] Int. Cl.[4] ..... B65B 23/00; B65B 55/20

[52] U.S. Cl. ..... 53/452; 53/472

[58] Field of Search ..... 53/449, 453, 452, 472, 53/474; 493/89, 904, 903

[56] References Cited

U.S. PATENT DOCUMENTS

| | | | |
|---|---|---|---|
| Re. 24,767 | 1/1960 | Simon et al. . | |
| 2,552,641 | 5/1951 | Morrison . | |
| 2,780,350 | 2/1957 | Simon et al. . | |
| 2,897,641 | 8/1959 | Simon et al. . | |
| 2,955,972 | 10/1960 | Wintermute et al. . | |
| 2,959,508 | 11/1960 | Graham et al. . | |
| 2,977,639 | 4/1961 | Barkhuff, Jr. et al. . | |
| 2,979,246 | 4/1961 | Liebeskind . | |
| 3,061,475 | 10/1962 | Wallace . | |
| 3,187,069 | 6/1965 | Pincus et al. . | |
| 3,204,385 | 9/1965 | De Remer et al. | 53/472 X |
| 3,222,843 | 12/1965 | Schneider | 53/449 |
| 3,253,064 | 5/1966 | Buonaiuto . | |
| 3,379,800 | 4/1968 | Wert . | |
| 3,415,364 | 12/1968 | Schneider . | |
| 3,419,134 | 12/1968 | Fitts | 53/472 X |
| 3,419,455 | 12/1968 | Roberts . | |
| 3,420,923 | 1/1969 | Ashworth et al. . | |
| 3,493,449 | 2/1970 | Krug . | |
| 3,564,811 | 2/1971 | Freeman | 53/474 |
| 3,618,287 | 11/1971 | Gobhai et al. | 53/472 |
| 3,623,931 | 11/1971 | Van Hosen . | |
| 3,630,819 | 12/1971 | Conger . | |
| 3,691,265 | 9/1972 | Cobbledick . | |
| 3,703,571 | 11/1972 | Roberts . | |
| 3,712,771 | 1/1973 | White et al. . | |
| 3,729,370 | 4/1973 | Cobbledick . | |
| 3,789,094 | 1/1974 | Hutchison . | |
| 3,867,240 | 2/1975 | Doerfling . | |
| 3,871,521 | 3/1975 | Szatkowski | 53/472 X |
| 3,912,107 | 10/1975 | Baumann . | |
| 3,950,462 | 4/1976 | Shaffer et al. . | |
| 4,087,389 | 5/1978 | Coppola . | |
| 4,114,213 | 9/1978 | Beernaerts et al. . | |
| 4,122,203 | 10/1978 | Stahl . | |
| 4,130,615 | 12/1978 | Decker, Jr. et al. . | |
| 4,244,764 | 1/1981 | Ginsburg . | |
| 4,248,646 | 2/1981 | Ginsburg . | |
| 4,339,039 | 7/1982 | Mykleby . | |
| 4,350,544 | 9/1982 | Matsuno . | |
| 4,379,103 | 4/1983 | Doerfling . | |

FOREIGN PATENT DOCUMENTS

| | | | |
|---|---|---|---|
| 637630 | 5/1950 | United Kingdom . | |
| 895242 | 5/1962 | United Kingdom | 53/472 |
| 1194447 | 6/1970 | United Kingdom | 53/472 |

OTHER PUBLICATIONS

Research Disclosure No. 18925, by G. W. Berg, Jan. 1980.

*Primary Examiner*—Horace M. Culver

*Attorney, Agent, or Firm*—Lerner, David, Littenberg, Krumholz & Mentlik

[57] ABSTRACT

A cushion packing material for use in protecting objects from shock and vibrational loads. The cushion packing comprises a dimensionally stable thermoformed shell forming a chamber therein of a predetermined configuration and having a foam material disposed therewithin so as to provide a molded density of less than or equal to 1.5 pounds per cubic foot. Preferably, the foam comprises a low density polyurethane foam. The dimensionally stable shell is thermoformed in a mold and is removed therefrom for filling with the low density foam. The cushion packing provides substantially equivalent or improved cushioning benefits in terms of dissipating dynamic forces at higher static stresses or loadings.

10 Claims, 11 Drawing Figures

METHOD OF PACKING OBJECTS AND PACKING THEREFOR

FIELD OF THE INVENTION

The present invention relates to cushion packing for protection of objects, and more particularly to a cushion packing and methods for the employment thereof which include a low density foam component for absorbing and dissipating shock and/or vibration loads.

DISCUSSION OF THE PRIOR ART

The desirability and necessity of packing objects so that they can be shipped or transported from one location to another without damage thereto is well known. Numerous packaging materials and techniques have been developed over the years for protecting and cushioning objects having a wide variety of sizes and shapes and a wide range of fragility characteristics. Some of these prior art packaging materials and techniques are of a customized design, providing for example specialized enclosures or configurations for supporting and holding particular shapes and sizes of objects, while others are of a standardized configuration and design for accommodating a variety of different sizes and shapes of objects. Furthermore, it is known that certain materials and packaging techniques are more suitable for packaging particularly fragile items so as to insure that necessary shock absorption or dissipation characteristics to prevent damage will be provided, while other materials and techniques are only suitable for packaging less fragile objects which can inherently withstand greater shock and/or vibrational loads without damage. Consequently, it will be appreciated that particular packaging materials and techniques are often chosen and designed with particular objects or articles in mind so that the dynamic forces which the object is likely to experience during shipment or transport (for example, as a result of the object or container therefor being dropped or jarred) can be harmlessly dissipated. Obviously, more fragile objects must be packaged so that the dynamic forces which will be transmitted through the packing material to the object will be less, whereas the degree of protection to be accorded more sturdy objects or articles can be less.

One factor which must be considered in designing particular packaging, particularly with respect to fragile objects, is the peak deceleration load which the object or article can withstand as a result of an externally applied force (such as being dropped) without breakage or damage. More particularly, the function of the packaging material is to absorb and dissipate harmlessly an externally applied force such that the shock or vibration experienced by the object will be below that which would result in damage to the article. For instance, fragile objects can generally only withstand low peak deceleration loads, while more sturdy objects are capable of withstanding greater peak decelaration loads. Therefore, in designing cushion packaging one must keep in mind that the packaging materials must be designed so as to provide a cushion or shock absorption characteristic such that the peak deceleration load which the object will experience is less than the peak deceleration load which will injure or damage the article. Often times, manufacturers of objects or articles will specify that the packaging materials must be such that the peak deceleration load which will be experienced by the object does not exceed a certain limit if dropped from a given height.

The peak deceleration loading which an object will experience if packed in a particular packaging material and dropped from a certain height can be varied by a number of factors, including the thickness of the cushion or packaging material and the static load on the cushioning material when the packaged article is at rest. For instance, peak deceleration values experienced by an object packaged in certain types of packaging material can be decreased by providing a greater thickness of cushion or packaging material, which will thus provide a greater distance within which to absorb and dissipate dynamic forces applied externally, such as when the packaged article is dropped.

The static load on the cushion packing material is determined from the weight of the article divided by the surface area of cushioning material which is in contact with and which supports the object. Static load considerations are important since generally certain types of cushioning or packaging materials are effective for minimizing peak deceleration loads within given ranges of static loads. Here it should be appreciated that static loads for a given packing material can be adjusted or varied to maintain desired peak deceleration characteristics by varying the amount of contact area between the packaging materials and the article to be packaged. For instance, it is generally known that many low density foam materials, such as polyurethane foams, are suitable for providing low deceleration characteristics at low static load conditions, while other types of materials such as polystyrene or polyethylene foams are more suitable for higher deceleration characteristics at higher static load conditions.

Another factor to be considered in designing packaging materials and techniques involves the costs of providing such packaging materials, not only from the viewpoint of the materials and processing costs, but also from the viewpoint of the associated effect on shipping or transportation costs. For instance, while greater shock absorbing protection can generally be provided by increasing the thickness of the cushioning materials surrounding an object, this necessarily increases the materials cost as well as the size of the containers in which the articles are packed. This in turn can increase transportation costs since a larger volume will be taken up with each packaged article. Needless to say, the lower the cost involved in providing a packaging material which meets desired design criteria, the more desirable the packaging material and associated technique.

One presently known technique for providing versatile cushioning of objects, particularly fragile objects, is the so called "foam-in-place" packing technique wherein a shipping carton or the like is initially partially filled with an expandable and uncured polyurethane foam mixture in a liquid or slurry form. Upon introduction into the carton, the foam mixture begins to expand or rise in comparison to its original liquid volume. Before expansion and curing is completed, the foam mixture is covered with a nondimensionally stable flexible plastic sheet, such as polyethylene film, and the object to be packed is then placed thereon. The expanding foam mixture follows any contours of the product to thereby begin to form a custom mold around the bottom half of the product. A second flexible sheet of polyethylene film or the like is then placed over the object, and the balance of the container is filled with additional expandable and uncured polyurethane foam mixture, again introduced in a liquid or slurry form. The container is closed and sealed, and the polyurethane foam mixture expands against the contours of the object and carton to encapsulate the product in a strong lightweight foam to thereby provide a customized protective package or packing. The customized pack is reusable after shipment for storing and/or further shipment of articles having the same general shape and configuration. Such a technique is shown generally in U.S. Pat. No. 3,618,287 to Gobhai. Additionally, variations of such a technique are shown in U.S. Pat. Nos. 2,780,350; 2,897,641 and U.S. Pat. No. Re. 24,767, as well as in U.S. Pat. Nos. 3,222,843 and 3,415,364.

An additional variation of this packing technique is one in which packaging cushions are custom premolded. In this technique, a thin film or sheet, such as polyethylene film, is placed or draped over or in a standarized specially designed mold which reflects the shape of the object to be packed. The lined mold is then filled with an expandable and uncured polyurethane foam mixture or the like, and the mold is then closed until the foam expands and sets to provide a molded cushion. After curing has been completed, the molded cushion covered with the thin film or sheet is then removed from the mold and may be used for protectively cushioning and supporting the object in a suitable container.

The aforementioned prior art foam-in-place and custom premolding prior art techniques are particularly useful with respect to fragile objects, and generally a low density polyurethane foam is utilized because of the very good cushioning effects it provides at a relatively low cost. For example, two inch thick cushions made from a polyurethane foam having a free rise density of 0.4 pounds per cubic foot are generally used in static load ranges of 0.25–0.45 pounds per square inch for providing peak deceleration loads in the range of 50–60 G's, whereas three inch thick cushions made from the same foam are generally used in the same static load ranges for providing peak deceleration loads in the range of 30–40 G's.

While such prior art protective cushion packages provide very good protection against shock and vibration for very fragile objects, it is to be appreciated that such good dissipation of dynamic forces is only achievable at relatively low static loadings. Consequently, very significant contact areas are required in order to achieve or maintain the desired cushioning benefits. This serves to increase the cost of providing the packaging material from the standpoint that more foam material is required than would otherwise be required to accommodate higher static loading. Further, the overall size of the package or container in which the article is to be shipped or transported must be somewhat larger. In this regard, it should be noted that such low density foams do not have significant mechanical strength properties in terms of providing desired resiliency under heavy static loads; instead, such low density foam materials are subject to shearing under heavy static loads. Thus, such low density polyurethane foams are to be contrasted with much more rigid polystyrene foams or polyethylene foams which are quite strong in comparision when they are removed from the container or carton. However, with such polystyrene and polyethylene rigid foams, the same or equivalent cushioning characteristics are not achievable. Basically, with the low density polyurethane foams which are used for providing cushioning protection for fragile objects and under low static load conditions, only the foam material directly beneath and in contact with the object to be protected provides the cushioning benefit or characteristics, with the surrounding portions of the foam simply serving to maintain an integral packaging cushion.

A further disadvantage of both of the above-discussed packaging techniques is that the resulting cushion or packaging which is formed is not particularly attractive in that the covering film or sheet assumes all types of crinkles and folds. Here it should be noted that such films or sheets in prior art packaging techniques and methods are essentially used to serve as a mold release to prevent adherence between the polyurethane foam and the object or article to be packaged in the customized cushion. If such a film or sheet were not used, the polyurethane foam mixture forming the packing or cushion would simply adhere to the product and/or the mold cavity, which obviously is undesirable, particularly if it is desired to reuse the customized cushions or packing or the molds. Also, the foam mixture must be introduced or placed in the polyethylene sheeting at the plant or location where the mold cavity is located since, if the polyethylene film is removed from the mold, it loses is molded shape. U.S. Pat. No. 3,187,069 teaches the manufacture of a cushioning or packing material wherein a flexible sheet is used for a mold release for foam blown into a mold cavity.

Also concerned with the cushion packaging field is U.S. Pat. No. 4,339,039 which is directed to impact resistant foam cushion packages. In accordance with this patent, preformed foam cushions are covered by an outer shell having air vents therein and are secured to the inside of a carton or container. The air vents in the outer shell serve to permit air or gas to escape from the foam when compressed by an object placed thereon or when the container is subjected to shock and/or vibration. The number and sizes of the air vents control the dynamic resistance characteristics of the foam cushions. Thus, it will be appreciated that this reference is mainly directed to providing certain dynamic resistance characteristics via the vehicle of controlling the escape of air contained within the foam during impact or compression. Here it should be noted that there is no teaching or suggestion of the particular types of foam materials, i.e., whether they are low or high density foams, or of the particular characteristics of the outer shell.

U.S. Pat. No. 2,979,246 is directed to the use of foam pads for packaging applications in which foam pads, having no outer covering or shell, are integrally attached to a container for providing cushioning properties or characteristics thereto.

While not concerned or directed to the field of cushion packaging, polyurethane foam and other foam materials contained within an outer plastic shell or liner have been used in a number of other fields or applications. For example, U.S. Pat. No. 4,130,615 discloses a method of making a thermal insulated container having a shock resistant bottom in which a flexible, vacuum formed liner of a desired configuration having a nonadhering material positioned on selected surfaces thereof is positioned over an expandable uncured urethane foam mixture disposed in the bottom of a container body so that the foam will expand against the liner. As the foam expands it adheres to the bottom of the container and to those portions of the liner which have not been treated with the nonadhering material. The use of the nonadhering material is stated to be for the purpose of providing better impact resistance characteristics to the resulting container.

A further example of such other types of applications is shown in U.S. Pat. No. 3,712,771 which is directed to the manufacture of furniture articles in which a thin sheet or film is vaccum formed into a shell of a desired configuration and into which an expandable uncured foam mixture is then introduced, the open end of the shell being covered with a paper backing sheet. Also, U.S. Pat. No. 4,114,213 discloses vacuum forming an outer layer and placing foam thereinto to form an upholstery article. Furthermore, U.S. Pat. Nos. 3,630,819 and 4,122,203 are both directed to building panels in which PVC or other sheet materials are initially vaccum formed and filled with expandable foam materials to produce building panels having a decorative outer surface, while U.S. Pat. No. 4,350,544 is directed to vacuum formation of a rigid PVC sheet which is attached to a backing with foam material added or introduced thereinto for making padded panels. Further, U.S. Pat. No. 2,997,639 discloses the use of an outer layer or sheet or polystyrene formed into a desired shape and then filled with foam for making refrigerator panels, lightweight shipping containers, life belts, etc. U.S. Pat. Nos. 3,420,923, 2,955,972; 2,959,508; 3,691,265; 3,867,240 and 3,729,370 are all directed to vaccum formed sheets of plastic material into which expandable, uncured foam material, such as a polyurethane foam mixture, is introduced and adheres to the vacuum formed sheet. These references are basically directed to the manufacture of crash pads, head rests, decorative panels and seat cushions for the automobile industry. U.S. Pat. Nos. 3,623,931; 3,379,800; 4,244,764; and 4,248,646 all disclose toilet seat constructions in which a sheet of plastic material is initially vacuum formed into a desired shape and an expandable foam mixture then dispensed thereinto. U.S. Pat. Nos. 3,419,455 and 3,703,571 disclose the manufacture of rigid decorative articles comprised of an outer shell and having foam material dispensed thereinto. U.S. Pat. No. 3,912,107 discloses a somewhat similar technique used in the construction or manufacture of liquid storage tanks. Finally, U.S. Pat. No. 3,950,462 is directed to the manufacture of storage inserts which include an outer layer of rigid plastic which is then filled with a polyurethane foam mixture.

Such prior art structures constructed of an outer shell or layer filled with a urethane foam or other foam material have not been used for or suggested for use in connection with the field of cushioning packaging. Here it should be noted that, for the most part, the outer shell component in such prior art structures, which can be constructed of various types of plastic material, has been used for providing an aesthetically pleasing outer surface for the finished product so as to be suitable for the various intended uses. In other words, since the foam materials generally have a porous rough outer surface or skin after curing, it is necessary to provide a suitable covering layer so as to provide a smooth, pleasing appearance. There has been no realization in such prior art structures of any improved cushioning type characteristics being provided, suitable for cushion packaging applications, for the foam material contained therewithin. That is, while such prior art structures might exhibit some resilient shock absorption characteristics, generally such resilient shock aborption characteristics would not be suitable for applications in the cushioning packaging field. Indeed, in many of these prior art structures, the foam material utilized has a relatively high density and therefore such structures are not suitable for use in connection with providing cushion packaging for very delicate or fragile objects. Further, with respect to many of these prior art structures, if a low density foam material, such as polyurethane foam, were utilized or employed, the resulting structures would not be suitable for the intended purposes of such prior art structures.

SUMMARY OF THE INVENTION

In accordance with the present invention there is provided an improved cushion packaging material and method of packaging objects, particularly fragile objects, which surprisingly exhibits improved cushioning characteristics and advantages over prior art packaging and methods. In accordance with one aspect of the present invention, there is provided a cushion packing for protecting an object to be packaged in a container. The cushion packing comprises a dimensionally stable outer shell forming a chamber or cavity therein of a predetermined configuration related to the object to be protected and the container in which it is to be packaged. A low density foam material is disposed within and substantially fills and conforms to the shape of the chamber formed by the outer shell, the foam material having a molded density of less than or equal to 1.5 pounds per cubic foot when disposed in the chamber. Also, the outer shell filled with foam material is adapted to be disposed in the container for the object and placed in contact with a portion of the object to thereby support and protect the object when packaged against shock and vibrational loads. The terminology "dimensionally stable" refers to an outer shell which, under its own support, is free-standing and does not collapse when it is otherwise unsupported. The term "low density" refers to a foam material which has a molded density, i.e., after curing, of less than 1.5 pounds per cubic foot.

In a preferred embodiment, the foam material comprises a low density polyurethane foam material which is particularly well suited for providing suitable cushioning characteristics for protection of fragile or delicate objects, but which is normally thought not to have adequate mechanical properties to give desired cushioning characteristics for packing under heavy static loads. For example, a static load of greater than 0.5 pounds per square inch for use in connection with a 36 inch drop height would be considered heavy, particularly in connection with multiple drops. Also in a preferred embodiment, the outer shell is sufficiently thin and flexible such that it will transmit a substantial portion of any force applied to its outer surface to the foam material which is contained therewithin for cushioning of such portion of such force.

The combination of a dimensionally stable outer shell and a low density foam has been found to produce a cushion packaging material which is capable of supporting greater static loads than that of the foam absent the dimensionally stable shell and which, at the same time, exhibits substantially the same or improved cushioning characteristics in terms of the dynamic forces or loads capable of being dissipated. This is believed to result from the use of an outer dimensionally stable shell which serves to maintain the integrity of the foam material disposed therewithin. In this regard, the foam densities presently used in the cushion packing industry for providing low deceleration impact protection of the articles packaged therewith are generally quite easy to puncture, and therefore are not particularly well suited for relatively high static load applications, i.e., they generally have poor mechanical strength properties. However, with the provision of an outer covering or shell which is dimensionally stable, the overall integrity of the cushion packing is improved significantly such that the same or improved cushioning characteristics are achieved at higher static loadings.

In addition, the aforenoted combination has a much longer life in terms of providing the desired cushioning characteristics over a plurality of shock applications, e.g., multiple drops. This is believed to result from the fact that the low density foam disposed within the cavity of the shell is guarded from mechanical shears and/or permanent deformation. Further, since the same or improved cushioning characteristics are achieved with the present invention at greater static loadings, less foam material in contact with the object to be supported and cushioned is required for providing the same degree of cushioning which can be accomplished with the use of conventionally known techniques. This can be particularly advantageous since a cushion packaging material can be produced at a lower cost. Also, with some objects it is not possible or practical to provide sufficient contact area between the cushion packing and the object to provide a low static stress or loading. Therefore, in such instances it is necessary to provide a cushion packing suitable for high static stress applications. The cushion packing in accordance with the present invention is capable of serving this need while providing good cushioning protection.

Still further, since less foam needs to be employed, the overall volume or size of the container in which the articles are to be shipped or transported may be less in some instances, which in turn reduces transportation costs. More particularly, since it is the thickness of the foam cushioning which generally controls the size of the container, because of improved cushioning characteristics achieved with the present invention, at least in some instances the thickness of the cushion packaging can be reduced and the size of the container similarly reduced. Further still, with the present invention, an attractively finished cushion packing is provided having an essentially smooth outer surface which can be colored or decorated as may be desired.

In accordance with a preferred embodiment, the dimensionally stable outer shell can be formed by means of a conventional thermoforming process in order to provide a shell having a cavity of a predetermined and desired configuration which will precisely or substantially precisely match the article or object to be packaged. Further, since the outer shell is dimensionally stable, shells can be produced at one location, and then shipped or transported to another location for subsequent filling with foam materials to produce the desired cushion packings. This is particularly advantageous since the dimensionally stable shells can be stacked in a nested arrangement and transported to remote locations for subsequent filling such that a minimum amount of space is taken up for shipping. This can substantially reduce the cost for producing the cushion packings since it is not necessary to ship finished cushion packings, nor is expensive thermoforming equipment required at a number of remote packaging locations to produce the outer shells. Rather the shells can be produced at one location and then subsequently shipped to a number of other filling locations or sites with relatively little expense involved.

In accordance with another aspect of the present invention, there is provided a method of packaging objects or articles in a container which comprises the steps of forming a dimensionally stable outer shell having a chamber or cavity therein of a predetermined configuration corresponding to the object to be shipped and to the container in which the object is to be packaged, filling the cavity of the shell with a low density foam so as to provide a molded density of less than or equal to 1.5 pounds per cubic foot, and thereafter positioning the dimensionally stable shells filled with the foam material in the container so as to be placed in contact with the object to be protected so as to protect the object against shock and vibrational loads. Such a packaging method is particularly advantageous since the dimensionally stable shells with the foam disposed therewithin are suitable for reuse after unpacking by an ultimate consumer or customer of the article, such as might be necessary in connection with storing or reshipping of the articles by the customer. Also, with such a method, a plurality of dimensionally stable shells can be formed and then nested together for shipment to a remote location for subsequent filling with foam material and placement in containers for packing of objects.

These and further features and characteristics of the present invention will be apparent from the following detailed description in which reference is made to the enclosed drawings which illustrate preferred embodiments of the present invention.

DESCRIPTION OF THE PREFERRED EMBODIMENTS

Figure 1:
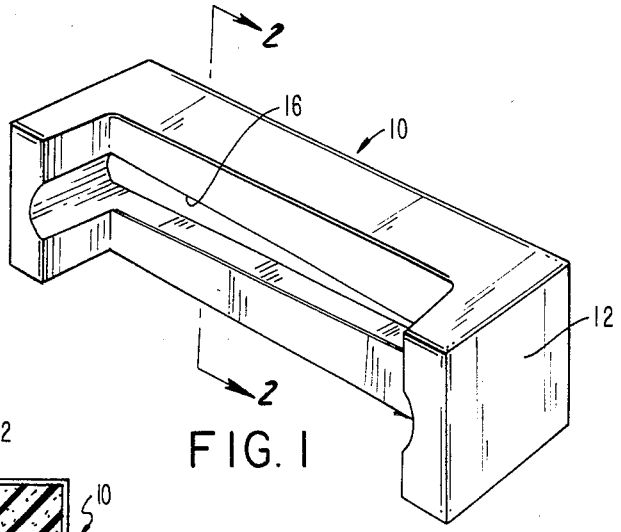
FIG. 1 is a perspective view of a cushion packing material in accordance with the present invention.

The cushion packing of the present invention is constructed from a dimensionally stable outer shell having a chamber or cavity therein of a predetermined configuration which is filled with a low density foam material. The term "dimensionally stable" as used herein refers to a shell which, under its own support, is free-standing and does not collapse when it is otherwise unsupported. The term "low density foam" as used herein refers to a foam material which has a molded density less than or equal to 1.5 pounds per cubic foot.

The low density foam material utilized in accordance with the present invention provides the basic cushioning protection of the packing material in order to protect an object from shock and/or vibration. As such, the foam material should exhibit good cushioning characteristics so as to be capable of compressing and absorbing an impact. Additionally, it is preferable that the foam also exhibit good resiliency characteristics so that it is capable of springing back or returning to substantially its original predetermined shape. Such foam materials comprise those foam materials which are presently used for low deceleration, low static stress or load applications in the cushion packaging art as described hereinabove under the Background of Invention section and are generally classified as flexible foams and semi-rigid foams. As noted therein, such low density foam materials generally have poor mechanical properties, especially when subjected to multiple impacts. In particular, such foam materials are known to exhibit shearing when placed under high dynamic stresses. Also, such foam materials tend to exhibit permanent deformation, e.g., flattening out when subjected to shock loadings. Thus, such foam materials generally are used as packing materials in a manner so as to provide relatively large surface areas in contact with the object to be protected and relatively large thicknesses of foam beneath such contact areas in order to thereby provide relatively large amounts of foam material for absorbing and dissipating shock and vibration loadings which the object might experience during shipping or transport or while it is being stored. Typical foam materials which provide these characteristics include the class of foam materials known as polyurethane foams.

Low density polurethane foams are generally produced by combining a multi-functional isocyanate or prepolymer component with a polyol component along with, if desired, catylsts, blowing agents, surfactants, flame retardants and/or other conventional adjuvants, to form an expandable uncured foam mixture. The expandable, uncured foam mixture is generally introduced into a mold chamber or cavity, or other confining object, in a liquid or slurry state where it then expands as it cures to substantially fill the mold cavity or chamber. As can be appreciated, the mold density for the foam material is dependent on the amount of mixture introduced into the cavity and the size of the cavity. For packing type applications to provide low peak deceleration load protection, the final mold density of polyurethane foam material (i.e., after curing) is generally approximately 1.5 pounds per cubic foot or less.

The outer dimensionally stable shell utilized in the cushion packaging of the present invention serves to provide the mold cavity or chamber for the foam material. The shell is designed so as to be sufficiently flexible so as to transmit any impact or dynamic forces to the foam contained therein which will provide the cushioning protection. In other words, the shell by itself is not sufficiently strong or of desired cushioning characteristics so as to provide any substantial cushioning benefits in and of itself. At the same time, in accordance with the present invention, the outer shell should be sufficiently strong and stiff so as to hold and maintain its shape when it is not otherwise supported in a mold cavity or filled with foam material. Preferably, the outer shell has a nominal thickness (i.e., before formation) on the order of 6–50 mils and more preferably on the order of 10–30 mils, and is made from a suitable material such that it will be sufficiently flexible to transmit impact or dynamic forces to the foam material contained therewithin and yet be sufficiently strong and stiff to hold and maintain its shape when otherwise unsupported.

Materials suitable for forming the dimensionally stable shell in accordance with the present invention include PVC, high density polyethylene (HDPE), low density polyethylene (LDPE), and other grades of polyethylene (such as linear low density polyethylene and polyethylene/EVA copolymers), PET, ABS, high impact polystyrene, polypropylene, filled polypropylene, cross-linked polyethylene foam, and Mylar, as well as many other thermoplastic materials. The selection of the material for forming the dimensionally stable shell includes consideration of the cost, impact strength, thermoformability, opacity and flame retardance. In the preferred embodiment, the dimensionally stable outer shell is formed into the desired predetermined shape from a sheet of PVC or polyethylene material having a nominal thickness of approximately 15–20 mils. Preferably, a thermoforming process is for transforming the sheet of plastic material into the desired shape in a suitably configured mold. In this regard, sheets of PVC or polyethylene of approximately 15–20 mils nominal thickness are capable of being thermoformed in a conventional manner and exhibit good impact strength of properties after formation.

Further in this regard, opacity is important since the resulting cushion packaging will have an aesthetically pleasing appearance after it is ultimately filled with foam material. If desired, the plastic sheet material may be colored in a suitable manner to further enhance the appearance of the resulting cushion packing material. Also, PVC or polyethylene material may be made to be flame retardant which provides obvious advantages for the resulting cushion packing.

After the dimensionally stable shell is formed, it may be removed from the mold and filled with low density foam material by introduction of an unexpanded, uncured foam mixture, in a liquid or slurry form, into the chamber formed by the dimensionally stable outer shell, the cavity or chamber then being closed while the foam material expands and cures to substantially and completely fill and conform to the shape of the chamber defined by the dimensionally stable shell.

In accordance with the present invention the outer shell component serves to maintain the integrity of the low density foam material contained therewithin, especially when subjected to multiple impacts or shock loads. This is also believed to be particularly important in minimizing or resisting permanent deformation of the foam material. That is, conventional low density foam cushion packing (which does not include a dimensionally stable outer shell) often has a tendency to deform permanently after shock loads, e.g., by flattening out and/or breaking apart. This permanent deformation or destruction generally worsens with multiple shock loadings. The provision of the outer shell tends to minimize or resist such permanent deformation and destruction, and thus insure that the desired quantity and configuration of foam material is maintained in order to provide the desired cushioning characteristics. Also, in those instances where the cushion packing includes recessed portions in which a part of the object is received, the outer shell is believed to bring into play a greater amount of foam material for absorbing and dissipating any dynamic forces which the cushion packing material supporting the object to be protected might experience. That is, while conventional cushion packing having recessed areas generally only brings into play that portion of the foam material which is in contact with the object and which is located between the point or location of impact and the portion of the foam material in contact with the object, in accordance with the present invention a greater amount of foam material is brought into play to provide cushioning protection. This is believed to be achieved as a result of the use of the dimensionally stable outer shell in combination with the low density foam material contained within the cavity formed thereby. Thus, when the packaged object is subjected to an impact or shock loading, not only the foam material located between the location of impact and in contact with the object, but in addition, surrounding portions of the foam material are also brought into play to provide additional cushioning benefit by virtue of the foam material being contained within the dimensionally stable outer shell. This is important since substantially the same low peak deceleration loadings for the object to be protected can be achieved at relatively higher static loadings for the packed object. Consequently, the same cushioning benefits or protection can be achieved with a lesser amount of foam material in accordance with the present invention.

This unique and surprising result achieved with the combination of a dimensionally stable outer shell and a low density foam, as taught herein, has not heretofore been recognized in the prior art. Rather, in accordance with prior art teachings, it would be expected that in order to achieve certain low peak deceleration loading for an object, the static loadings for foam material of a given thickness would have to lie within a given range. Therefore, in order to maintain or provide desired peak deceleration loading for heavier and larger size objects, it was necessary in the prior art to provide an increase in the area of foam contact with the object to be protected, or to use a different foam material which is more suitable for higher static load applications. On the other hand, in accordance with the cushion packing material of the present invention, the amount of contact area may be significantly less to achieve substantially equivalent peak deceleration protection. Furthermore, with the cushion packing material of the present invention, greatly improved results are achieved with respect to multiple drop or shock loadings. This latter feature is believed to be obtained also as a result of the combination of a dimensionally stable outer shell and a low density foam contained therewithin.

The result achieved with the present invention is in direct contrast to that which was generally accepted and expected in the cushion packaging industry. Specifically, persons skilled in the art of cushion packing were of the opinion that the use of a dimensionally stable, relatively hard shell for containing a low density foam material would not provide the desired cushioning characteristics, it being thought by such persons that at best only the equivalent or slightly lower cushioning benefits would be obtained for the same static loading of cushion packages. However, in spite of such thoughts, the present inventors forged ahead and discovered that the combination of a dimensionally stable outer shell with a low density foam material provided in the cavity thereof achieved improved cushioning characteristics, providing in essence equivalent or improved cushioning protection at higher static loadings. This thus affords the capability of providing better performance at lower or comparable costs, and in addition, affords the capability of providing suitable low density foam cushion packing for use with those objects in which only relatively high static stress loadings are feasible or practical. The improved performance is believed to result from the fact that the outer shell tends to maintain the integrity and shape of the foam material during use. In particular, the outer shell resists permanent deformation or destruction so that the desired quantity and configuration of the foam material for providing desired cushioning protection is maintained. In addition, in those instances in which the cushion packing is configured to have surrounding portions of foam material which are not in contact with the object or located directly between location of impact and the contact with the object, the outer shell is believed to have a load spreading effect which tends to bring into play a greater amount of foam material than the foam material which is provided directly between the area of impact and the supported portion of the object to be protected. Thus, the cushion packaging in accordance with the present invention serves to provide an alternative for so called fabricated foams which are generally applicable at greater static stress loading for accommodating or providing low peak deceleration protection. Furthermore, since less foam needs to be employed with the present invention in order to provide desired cushioning benefits, in some instances, smaller sized cushion packing for a given application may be utilized which provides the attendant benefits of lower cost, not only from the viewpoint of the cost of the cushion packaging material itself but also from the viewpoint of providing smaller sized overall packages in which the objects to be packed are protected, thereby resulting in less volume being taken up in shipping and/or storage. In particular, since the thickness of the cushion packing generally governs the size of the overall container, and since improved cushioning characteristics are achievable with the present invention, at least in some instances the thickness of the cushion packing can be reduced which in turn allows the overall size of the container to be reduced. This in turn can result in a reduction in shipping and/or storage costs which may be significant.

Furthermore, an added benefit provided by the present invention is the capability of providing aesthetically pleasing cushion packing for low density polyurethane foams in foam-in-place type applications at an end user's facility, i.e., in applications where packing personnel produce their own cushion packing at the packing facility by filling a carton or mold with an expanding polyurethane foam mixture which expands and conforms to the shape of the carton or mold. Previously in such foam-in-place applications (as noted hereinabove), the expanding foam mixture was introduced into a carton and covered with a thin flexible plastic sheet with the article placed thereon, or was introduced into a specially designed standardized mold lined with a thin film or sheet, the specially designed mold reflecting the shape of the object to be packed. In such prior applications, the resulting cushion or packaging was not particularly attractive since the thin film or sheet of plastic assumes all types of wrinkles and folds. With the present invention, however, the dimensionally stable, preformed shell can be filled with an expanding foam mixture by packing personnel at the end user site to provide an aesthetically pleasing cushion packing, an advantage which heretofore was not obtainable.

Figure 2:
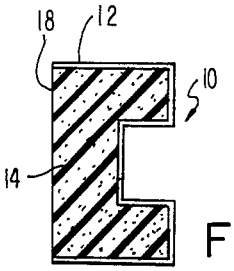
FIG. 2 is a cross-sectional view of the cushion packing of FIG. 1 taken substantially along the lines 2—2 thereof.

Refering now to the figures, and more particularly FIGS. 1 and 2, there is illustrated therein a cushion packing element 10 constructed in accordance with the principles of the present invention. The packing element 10 includes a thermoformed dimensionally stable outer shell 12 having a cavity or chamber 18 therein of a predetermined configuration which is substantially filled with a low density foam material 14. More particularly, the dimensionally stable outer shell 12 is preferably formed from a plastic sheet material, such as PVC or polyethylene, via means of a conventional thermoforming process so as to include a recess 16 therein which is configured to closely approximate a portion of an object to be supported and protected thereby. After thermoforming of the outer shell 12, a suitable foam mixture in an unexpanded uncured state, such as for example a polyurethane foam mixture, is introduced into the cavity or chamber 18 in a liquid or slurry form. The open end of the cavity 18 is then closed as the foam material expands and cures to substantially completely fill and conform to the shape of the chamber 18 defined by the shell 12. The amount of foam material introduced into the chamber 18 is controlled so that the molded density of the cured foam contained within the shell 12 is approximately 1.5 pounds per cubic foot or less. It will be appreciated that the final molded density is dependent upon the amount of foam mixture introduced into the cavity 18 as well as the size of the cavity and the composition of the foam material in terms of its free rise characteristics. In this regard, if a polyurethane foam mixture is utilized, and depending on the material from which the shell 12 is made and/or any treatment methods to the shell 12, the foam during expansion and curing will adhere to the inner walls of the outer dimensionally stable shell 12. This occurs naturally with the PVC material for the shell 12, and can be made to occur with a polyethylene material through the employment of known treatment techniques.

Figure 3:
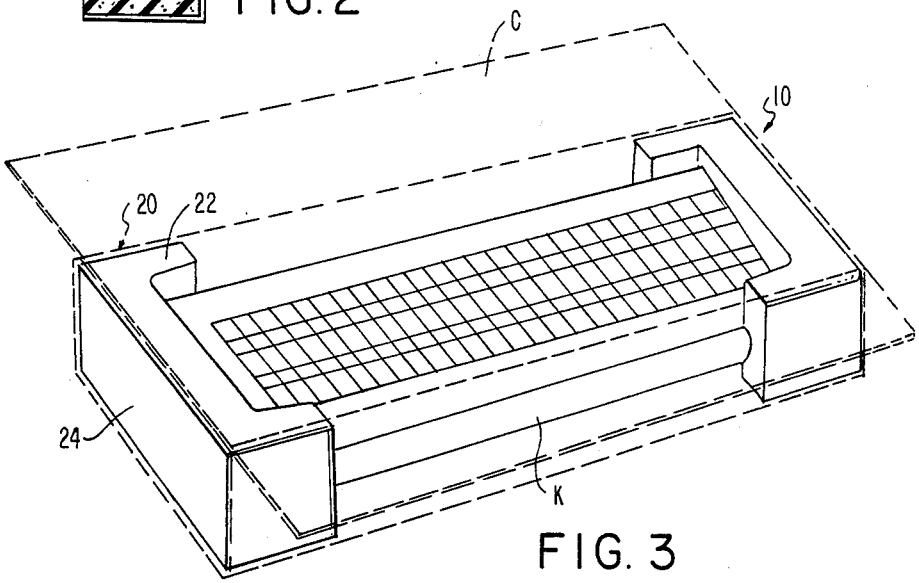
FIG. 3 is a perspective view of a pair of packing elements such as shown in FIGS. 1 and 2 supporting a keyboard.

The particular packing element 10 shown in FIGS. 1 and 2 has been configured for supporting and protecting one end of a keyboard K for shipment or transport. More particularly, as best illustrated in FIG. 3, the recess 16 formed in the packing element 10 is configured so that it closely approximates the dimensions of one end of the keyboard K which is to be supported thereby. A similar packing element 20, also formed of a dimensionally stable outer shell 22 having a chamber filled with a low density foam material 24, is provided for supporting the other end of the keyboard K. When the packing elements 10 and 20 are disposed on the ends of the keyboard K, the keyboard K can be inserted into a suitable shipping carton or container such as a corrugated cardboard box B, shown in phantom in FIG. 3 or the like, and can be readily transported using conventional handling techniques to its ultimate destination without worry of injury or damage thereto. In this regard, the overall size of the packing elements 10 and 20, when fitted onto the ends of the keyboard K. should closely approximate the internal dimensions of the container so as not to be loosely positioned or packed therein. This can be accomplished by control of the size of the packing elements 10, 20 and/or of the container therefor. When the keyboard K reaches its final destination, the packing elements 10 and 20 can be readily removed from the ends of the keyboard, and saved for further shipping and/or storage.

It will be appreciated from reference to FIGS. 1–3 that the particular object to be supported and protected by the cushion packing elements 10 and 20, namely the keyboard K, is supported and protected so as to be capable of absorbing shock or vibration loadings in substantially all directions when the keyboard K and packing elements 10, 20 are placed or packed in the suitable shipping container or box B. More particularly, it will be noted that the bottom and top of the keyboard K as illustrated in FIG. 3 are located inwardly from the top and bottom surfaces of the box B, while the ends and sides of the keyboard K are located inwardly of the inner end and side walls of the box B. Thus, if the box B is dropped so that it lands on its bottom wall, dissipation of the dynamic forces or impact loadings will be provided by the lower sections or portions of the cushion packing elements 10 and 20. Similarly, if the box B is dropped so that one of the side walls impacts the ground, protection will be provided by the corresponding end sections of the cushion packing element 10, 20. Still further, if the box B is dropped so as to land on one end surface, the side portion of the corresponding cushion packing elements 10 or 20 would provide shock absorbing protection for the keyboard K. Finally, it will be appreciated that a drop of the box B so as to land on or impact on one edge or corner would bring into play corresponding portions of the cushion packing elements 10, 20. Thus, protection against shock and/or vibration will be provided for virtually any type of shock loading such as might occur if the box B is dropped or subjected to vibration during shipment and/or storage.

The degree of protection which will be provided by the cushion packing elements 10, 20 is dependent upon a number of factors. One particularly important factor or consideration to be taken into account in designing any cushion packing material is the peak deceleration which the packaged object will experience if dropped from a given height. Because of the large number of factors and considerations which go into determining the peak deceleration loadings, generally curves are developed by manufacturers of packing materials based upon certain types of foam materials, the drop height, the amount of cushioning material which is provided within which to absorb the shock loading and the amount of foam material in contact with the object, this latter factor being represented by the static stress on the packing material, i.e., the weight of the object divided by the area of foam or packing material in contact therewith when the object and package is at rest. By utilizing peak deceleration load vs. static stress curves for particular foam materials and particular cushion thicknesses, the manufacturers of packing materials can design particular shapes or configurations for the cushion packing elements to provide the desired protection in conventional manners.

Figure 4:
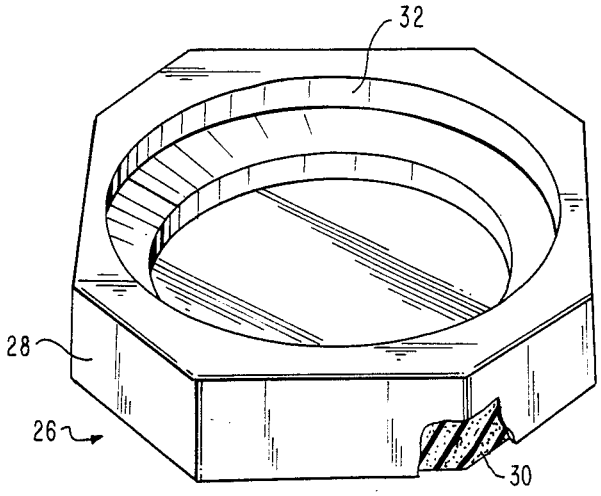
FIG. 4 is a perspective view of an alternate form of a cushion packing material in accordance with the present invention for cushioning a computer disc pack.

It will therefore be apparent that the packing elements 10, 20 as illustrated in FIGS. 1–3 could be differently configured for this or other applications. For instance, the packing elements could be configured as two mating halves, the bottom half accommodating the bottom half of the keyboard and the top half accommodating the top half of the keyboard, with the two packing elements sandwiching together the keyboard therebetween for shipment. It will further be apparent that virtually any object, regardless of its shape, can be accommodated by one or more packing elements which have shells preformed with chambers shaped to accommodate selected portions of the objects to be shipped. In this regard, as a further example, reference is made to FIG. 4 which illustrates therein a packing element 26 suitable for providing cushion protection for a computer disc pack. Again, packing element 26 includes a dimensionally stable shell 28, constructed as hereinbefore described by a conventional thermoforming technique, which is then filled with a low density foam 30, also as previously described. The shell 28 forms a recess 32 therein for accommodating and supporting the lower half of a computer disc pack which is to be protected. A similarly shaped packing element (not shown) would be provided for placement over the top half of the computer disc pack before placement of the disc pack and cushion packings within a suitable carton or container.

Aside from the configurations for packing elements as heretofore shown and described, it is well within the skill of one of ordinary skill in the art to configure differently shaped packing elements for different applications, the essential feature bringing such packing elements within the scope of the present invention being the combination of a dimensionally stable outer shell having a chamber or cavity therein of a predetermined configuration which is substantially filled with a low density foam material, i.e., a foam material having a density of less than or equal to 1.5 pounds per cubic foot. The particular configurations for the outer dimensionally stable shells, and thus the configurations for the various packing elements, would be dependent upon the conventional considerations in determining the peak deceleration loadings for which protection is to be provided in conventional manners, based upon peak deceleration loading vs. static stress for cushioning packings in accordance with the present invention. In this regard, as noted hereinabove, with the cushion packings in accordance with the present invention, essentially equivalent or improved cushioning benefits in terms of accommodation of low peak deceleration loadings can be achieved at higher static stresses or loadings, which in turn permits the utilization of less foam material for accomplishing essentially equivalent or improved cushioning benefits. The techniques for designing particular configurations for packing elements based upon satisfaction of particular peak loading requirements can be achieved utilizing packing elements in accordance with the present invention in a similar manner by utilizing different peak deceleration loads vs. static stress loading curves.

An additional advantage in accordance with the present invention is that it can be employed in a method which greatly reduces the cost of packing. Specifically, a plurality of dimensionally stable outer shells can be vacuum thermoformed from a thermoformable material at a particular location. These thermoformed outer shells can then be stacked or nestled together and shipped to a remote location. At the remote location, the shells can be separated, placed in relatively inexpensive filling fixtures, and then filled at that location with a suitable low density foam material to produce packing elements having desired cushioning characteristics. The packing elements, with the foam therein, can then be employed to pack the objects for shipment. Thus, it will be appreciated that separate and relatively expensive thermoforming equipment and special forming molds will not be required at each location which foam material is to be produced in a desired shape or configuration. More particularly, since the outer shells in accordance with the present invention are dimensionally stable, and therefore maintain and hold their shape under their own support, the shells can be manufactured at one location and shipped for filling at a remote location with a low density foam material. Further, because of the nestability feature of the present invention, shipment of the shells will not entail occupation of a large volume of space being taken up which would otherwise increase transportation and processing costs.

Figure 5:
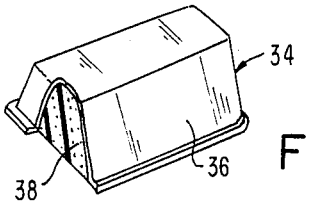
FIG. 5 is another embodiment of a cushion packing incorporating the principles of the present invention for use in cushioning electronic equipment.
Figure 6:
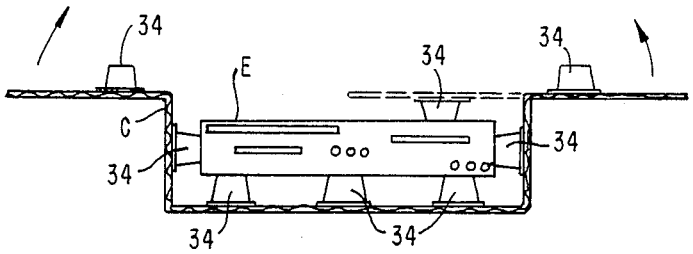
FIG. 6 is a cross-sectional view of a packing application employing the packing elements constructed in accordance with FIG. 5.

Another feature in accordance with the present invention is shown in FIGS. 5 and 6 which illustrate the use of a plurality of individual packing elements or pads 34, each formed of a dimensionally stable shell 36 and having a low density foam material 38 disposed in the cavity formed thereby. In this regard, it will be appreciated from FIGS. 5 and 6 that the packing elements 34 all have the same general configuration and are designed and placed in a container or carton C so that the object E to be packed and protected will be spaced from the walls of the container C. More particularly, in the embodiment shown in FIGS. 5 and 6, the packing elements 34 are configured as truncated pyramids in which the exposed foam surface comprises the base of the packing elements 34. The exposed foam surface of the formed packing elements 34 may be coated with a suitable adhesive, not illustrated, so that the packing element can be adhered to the inner surface of the carton C. It will be appreciated from FIGS. 5 and 6 that the packing elements 34 are designed so that the truncated surface (i.e., the surface opposite from the base or exposed foam surface) thereof will be contacted entirely by the object E to be packed. In other words, no recessed area is provided in the outer surface of the shell 36 to receive a particular portion or segment of the object E to be protected, in contrast to the packing elements 10, 20 and 26 shown in FIGS. 1–4. The thickness or height of the packing elements 34 is chosen in relation to the size of the container C and object E to be packed so that, when the packing elements 34 are strategically placed at points within the container C to support a particular object, such as a piece of electronic equipment E, and the flaps of the container C are closed, the electronic equipment E will be securely maintained in position for shipment.

Thus, it will be appreciated that the packing elements 34 serve essentially as compression members for supporting the object to be protected. While packing elements 34 generally would not be subjected to mechanical shear type forces such as the packing elements 10, 20 and 26 (since the entire truncated surface of the elements 34 will be loaded or contacted by the object E), the provision of the outer dimensionally stable shell 36 serves to protect the packing elements 34 from permanent deformation when in use. This is believed to be the result of the shell component 36 insuring that the integrity and shape of the foam component 38 is maintained when loaded. Here it is noted that low density foam compression pads of the prior art, in which no dimensionally stable shell is provided, tend to flatten out and become permanently deformed and/or break apart during use, which in turn results in a significant reduction or destruction of the cushioning characteristics, particularly in multiple drop situations. With the packing elements 34 in accordance with the present invention, the integrity of the foam material 38 is maintained and the extent of permanent deformation is less, while cushioning characteristics are improved.

Further in accordance with a preferred embodiment portions of the carton C can be used advantageously to close the open end of the cavities in the shells 36 after the liquid or foam mixture is disposed or introduced into the cavity or chamber of the particular packing elements 34. When a polyurethane foam mixture is used in this manner, which has high adhesion characteristics, the foam material will adhere to the portion of the carton closing the open end of the cavity, thus forming an integral carton having packing elements therein. This is advantageous since it is not necessary to utilize a separate adhesive for adhering the packing elements 34 to the interior walls of the carton C.

To further understand and illustrate the desirable effects achieved by the combination of a dimensionally stable outer shell having a low density foam therein in accordance with the present invention, reference is made to FIGS. 7–11 which illustrate peak deceleration vs. static stress curves for different types of prior art cushion packing materials vis-a-vis a cushion packing in accordance with the present invention.

Figure 7:
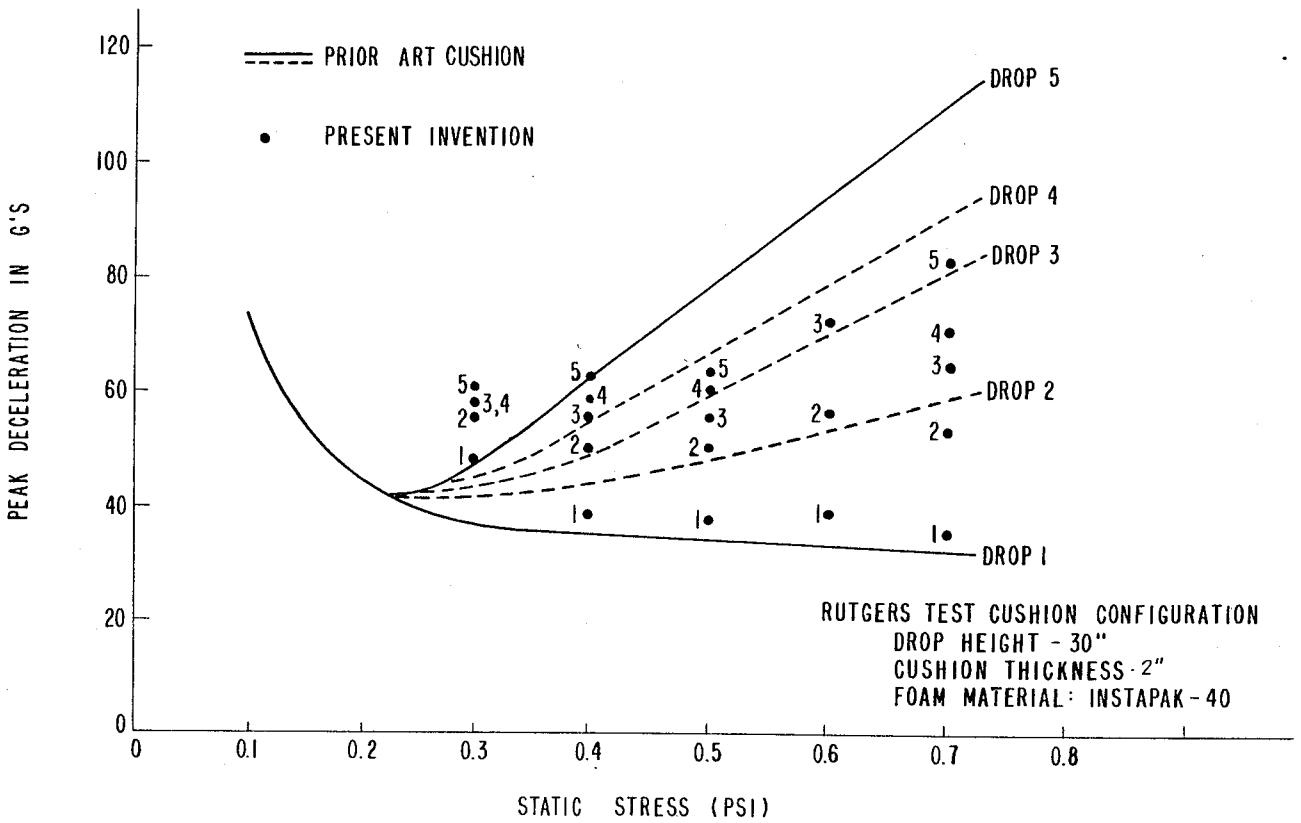
FIG. 7 is a graphic representation of a standard drop test comparison of peak deceleration vs. static stress for a cushion packing constructed in accordance with the principles of the present invention and prior art cushion packing of the type comprising a low density polyurethane foam without a dimensionally stable outer shell, the drop height being 30 inches, the cushion thickness being 2 inches, and the foam material utilized being one having a free rise density of 0.4 pounds per cubic foot.
Figure 8:
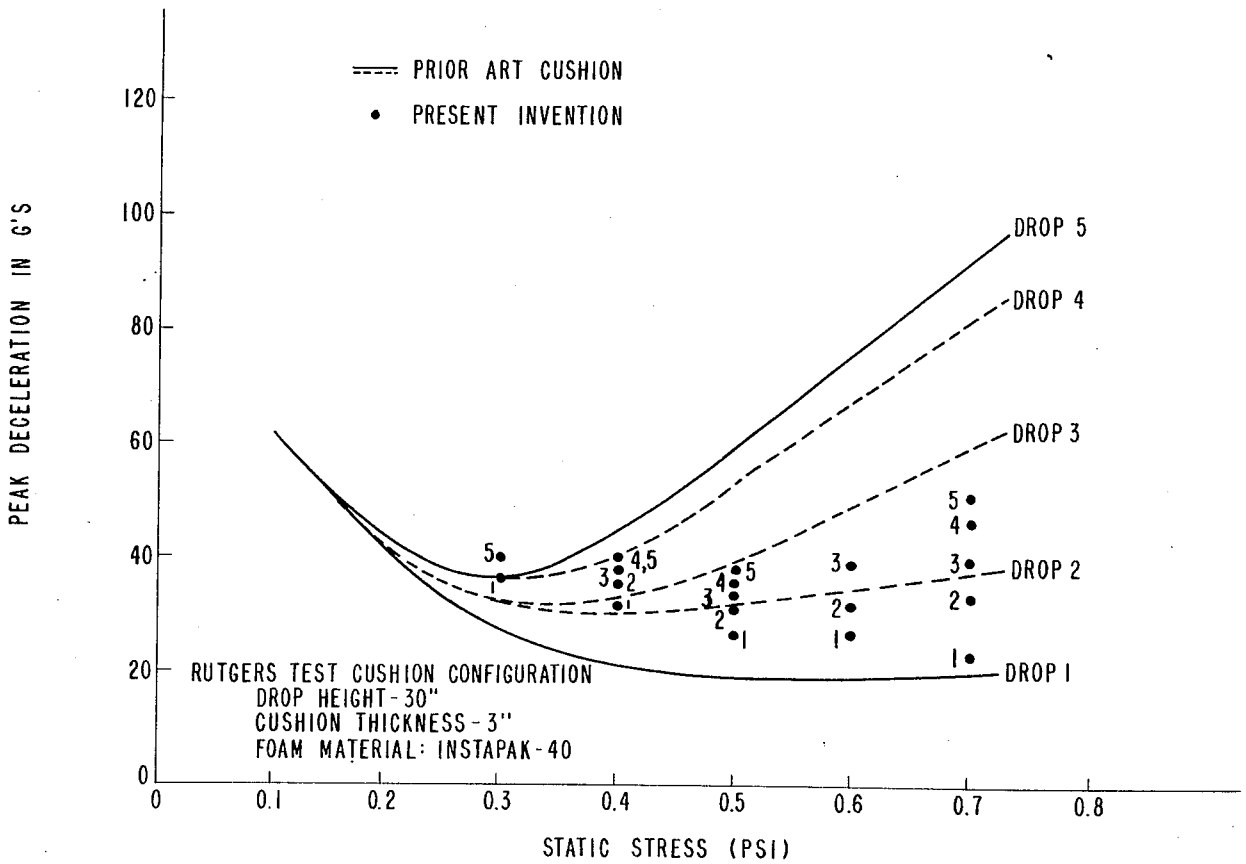
FIG. 8 is a graphic representation similar to that of FIG. 7, but for cushion thicknesses of 3 inches, the drop height and foam material being the same as utilized with respect to FIG. 7.

More particularly, FIGS. 7 and 8 represent graphs of data using Rutgers test cushion shapes to illustrate a comparison between cushion packing elements of the present invention and corresponding prior art cushion packings of the type utilizing the same type of foam material but not employing a dimensionally stable outer shell. A Rutgers test cushion, as known in the industry, is one which is approximately twelve inches square and has a symmetrical center recess of approximately eight inches square. The end portion of the cushion, i.e., the portion outside or surrounding the recess, is two inches in height above the recess, and the thickness of the cushion beneath the recess portion is variable for particular tests or curves. For the data represented in FIG. 7, the thickness beneath the recess portion was two inches, while for the data represented in FIG. 8 the thickness was three inches. Also, for the data shown in each of the FIGS. 7 and 8 the drop height was thirty inches. In addition, for the data shown in each of the FIGS. 7 and 8, the particular foam material utilized comprised "Instapak-40" foam sold by Sealed Air Corporation. This polyurethane foam mixture has a free rise density of 0.4 pounds per cubic foot. The molded foam density with respect to the Rutgers test cushions of both the prior art and the present invention was approximately 0.68 pounds per cubic foot.

The solid and dashed lines illustrated in FIGS. 7 and 8 represent test data taken with respect to Rutgers test cushions in which the foam material was covered with a thin, nondimensionally stable flexible polyethylene film which mainly served to prevent adherence of the foam material to the mold cavity in which the test cushion was produced. The test cushions were subjected to several drops from the stated height of 30 inches, represented by the lines labeled drops 1, 2, 3, 4, and 5, for different static stresses or loads, and the peak deceleration loadings, in G's, were determined. The curves were then generated from the resulting test data. Thus, it will be appreciated that the solid and dotted line curves of FIGS. 7 and 8 represent the peak deceleration loads experienced by objects packed with conventional low density foam cushions characteristic of the prior art in which no dimensionally stable outer shell is provided within which the foam material is disposed.

For comparison purposes, similarly shaped Rutgers test cushions were constructed using a thermoformed PVC material having a nominal thickness of approximately 10 mils before forming, which were then filled with the same type of polyurethane foam mixture (i.e., "Instapak-40") to have the same molded density (i.e., approximately 0.68 pounds per cubic foot). The data illustrated in FIGS. 7 and 8 with respect to test cushions in accordance with the present invention are shown by the individually labeled points or dots. Several different tests were made with respect to each of the various cushions for different static stresses, which correspond to the weight of the object divided by the area of the cushion which is in contact therewith. The test data points labeled 1 represent the test data for the first drop, with the test points labeled 2 being representative of the test data for the second drop, those points labeled 3 for the third drop, points 4 for the fourth drop and points 5 for the fifth drop.

Surprisingly, it was found that the peak deceleration loadings for the test cushions in accordance with the present invention were approximately equivalent for the first and second drops to those for conventional cushions having no dimensionally stable shell, and were significantly improved for the third, fourth and fifth drops over conventional cushions, particularly at higher static stresses, i.e., greater than 0.5 pounds per square inch.

More particularly, it is clear from the graphs shown in FIGS. 7 and 8 that the peak deceleration in G's which are experienced by the object to be protected, for a given static stress, is roughly equivalent for the test cushions in accordance with the present invention and of the prior art for the first and second drop tests, i.e., the provision of the dimensionally stable shell does not hinder the cushioning characteristics during the first and second drops. Further, as additional drop tests are performed on the same material, a significant improvement in terms of cushioning benefits is realized with the present invention in comparison to the prior art cushions. Specifically, with respect to multiple drops, there is a marked shift to the right of the curve so that multiple drop performance is better with the cushion packings of the present invention. In this regard, the improvement enjoyed by the packing cushion in accordance with the present invention which includes a dimensionally stable outer shell is much more markedly apparent with reference to FIG. 8 wherein the peak deceleration characteristics experienced on the object are significantly lower on the third, fourth, and fifth drop tests. Also, the rate of rise of the curves representing peak deceleration in G's vs. static stress are markedly sharper with the foam material alone than with the cushion packing of the present invention.

Therefore, it will be appreciated that the object to be packaged is protected in a better manner with the present invention. Also, it will be appreciated from both FIGS. 7 and 8 that the benefits achieved with the present invention are more pronounced at higher cushion thicknesses, which are used to provide very low peak deceleration loadings which an object will experience. In other words, when the cushion thickness is three inches as opposed to being two inches, the benefits achieved with the present invention are substantially the same with respect to first drop test data but significantly improved for multiple test drop data particularly at the higher number of drops.

Thus, it will be appreciated from FIGS. 7 and 8 that the marked improvement in accommodating the peak deceleration loading characteristics by the combination of a dimensionally stable outer shell with a low density foam, as compared to the foam itself, graphically illustrates the unexpected result obtained with the present invention; unexpected since those of ordinary skill in the art thought that adding a dimensionally stable outer shell would provide less cushioning benefits instead of greater cushioning benefits such as shown in the graphs illustrated in FIGS. 7 and 8.

Figure 9:
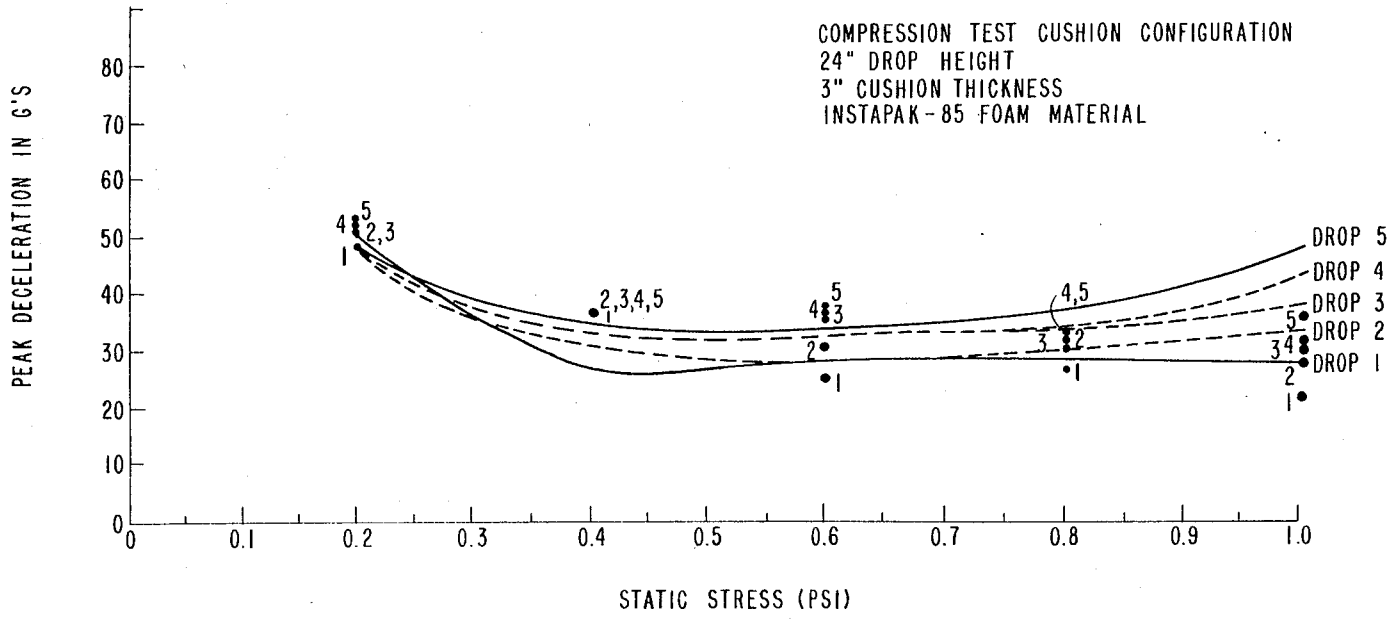
FIG. 9 is a graphic representation similar to that of FIGS. 7 and 8, but for a differently configured cushion packing and in which the foam material utilized had a free rise density of 0.85 pounds per square foot. The drop height was 24 inches and the cushion thickness was 3 inches.
Figure 10:
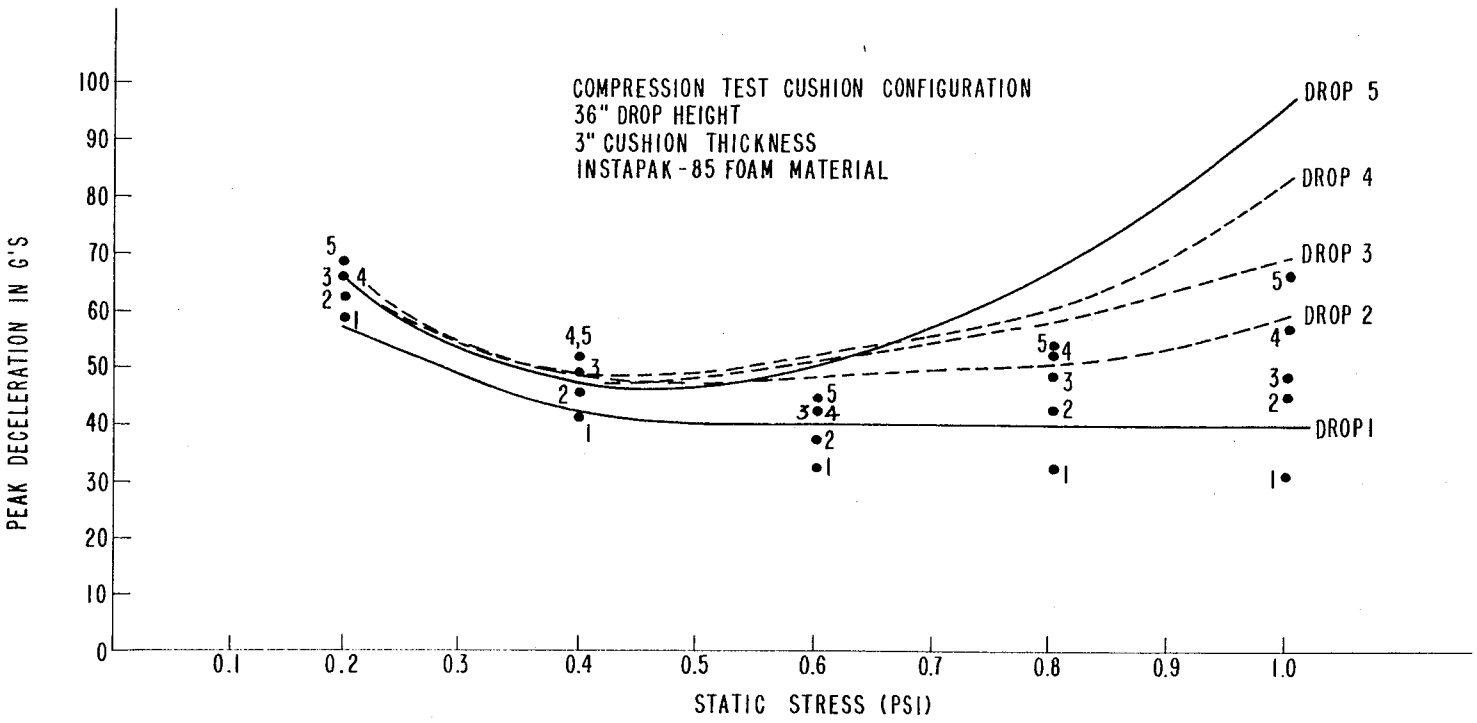
FIG. 10 is a graphic representation similar to that of FIG. 9, but for a drop height of 36 inches, the configuration, foam material and cushion thickness being the same as utilized with respect to FIG. 9.

FIGS. 9 and 10 are graphic representations similar to these of FIGS. 7 and 8, but for compression test cushions (as opposed to Rutger's test cushions) and for higher density foam material. More particularly, FIGS. 9 and 10 represent graphs of data using compression test cushions which are similar in configuration to the packing elements 34 shown in FIGS. 5 and 6 and in which the test cushions were constructed with "Instapak-85" foam material. This foam material comprises a polyurethane foam having a free rise density of 0.85 pounds per cubic foot. Again, test cushion shapes in accordance with the prior art, i.e., having a thin flexible film covering the foam material, and in accordance with the present invention were made. The outer shell of the compression test cushions in accordance with the present invention were thermoformed from a PVC material having a nominal thickness of 20 mils. The molded foam density of each of the compression test cushions was approximately 1.1 pounds per cubic foot. The test cushions were then subjected to several drops at different heights, 24 inch drop height results being represented in FIG. 9 and 36 inch drop height results being represented in FIG. 10. As with FIGS. 7 and 8, the results of peak deceleration vs. static stress for prior art type cushions are represented in FIGS. 9 and 10 by lines labeled drops 1, 2, 3, 4, and 5. The results for cushions in accordance with the present invention are represented in FIGS. 9 and 10 by individually labeled points or dots, the points labeled 1 being representative of the test data for first drops, the points labeled 2 being representative of the test data for second drops, etc.

Again, the test data represented in FIGS. 9 and 10 confirm the significantly improved cushioning characteristics afforded by the present invention in comparison to the prior art type cushions in which no dimensionally stable shell is provided. Specifically, the peak deceleration experienced by the object to be protected with the cushion packing of the present invention, for a given static stress, is equivalent or improved for first and second drops over prior art type compression cushions and is significantly improved for third, fourth and fifth drops, particularly at higher static stresses. Further, the improvement provided by the cushion packing in accordance with the present invention which includes a dimensionally stable outer shell is much more significant at higher drop heights. Indeed, as is apparent from FIG. 10, the peak deceleration experienced by the object is significantly lower for the cushion packing of the present invention for all drops when the static stress is greater than 1.5 pounds per square inch, with the degree of improvement in comparison to the prior art type cushion increasing as the static stress increases and as the number of drops increases.

Figure 11:
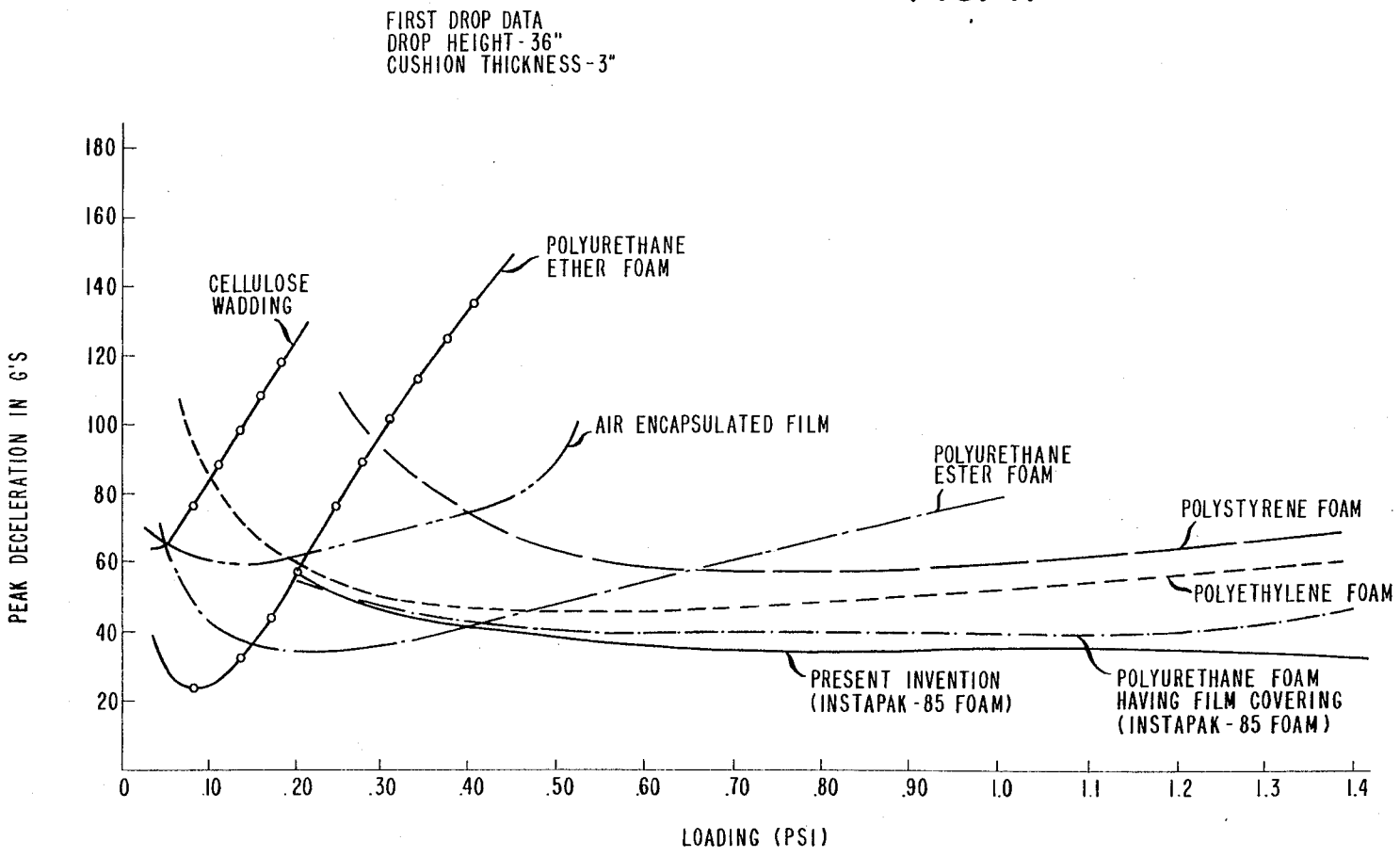
FIG. 11 is a graphic representation of peak deceleration vs. static stress for numerous prior art cushion packing materials and cushion packing material constructed in accordance with the principles of the present invention, the various curves representing first drop data only.

To put the teachings of the present invention in proper perspective in regard to other materials known in the prior art for use in connection with cushion packaging, reference is made to FIG. 11 which represents first drop data for a thirty-six inch drop height, a three inch cushion thickness, and compression test cushion shapes. The data shown in each case is for a single drop for an 8 by 8 inch by 3 inch thick compression type test cushion, with the exception of the prior art "polyurethane foam having film covering" cushion and the present invention test cushion. The test data for these later two test cushions was derived with respect to the same test cushion used to generate the data shown in FIGS. 9 and 10 in which the test cushions were approximately 5 by 5 inches by 3 inches thick, and in which the molded density of the foam was approximately 1.1 pounds per cubic foot. It is to be noted that although there are differences in dimensions between the cushions used for the present invention and that for certain of the prior art materials, such differences are not believed to significantly affect the overall test data shown in the graph.

Again, the graph illustrated in FIG. 11 shows peak deceleration experienced by an object, in G's, against static loading in pounds per square inch. The particular prior art materials utilized comprise cellulose wading, polyurethane ether foam, air encapsulated film, polyurethane ester foam, polystyrene foam, polyethylene foam and a polyurethane foam having a thin flexible film covering. None of the prior art materials included an outer dimensionally stable shell. The cushion packing in accordance with the present invention illustrated in FIG. 11 comprised a dimensionally stable outer shell having a low density foam material therein, specifically "Instapak-85" foam material.

A review of the data illustrated in FIG. 11 shows that the present invention, as compared to any other material, had a lower peak deceleration over a greater loading range and, above approximately 0.5 pounds per square inch static stress, no other material had a lower peak deceleration in G's. This graphically illustrates the advantages enjoyed by the present invention which will provide certain desired cushioning benefits relative to other materials known in the prior art at a relatively higher range of static stresses or loading. While polyurethane ether foams and polyurethane ester foams do provide lower peak deceleration loadings at very low static stresses or loadings, as illustrated in FIG. 11, such prior art materials have a very limited usefulness in terms of static stress ranges.

Thus, this graphic representation of data illustrated in FIG. 11 shows that the cushion packing fabricated in accordance with the present invention is particularly applicable for providing low peak deceleration loadings for a very large range of static stresses or loadings, and in particular, in light of FIGS. 7–10, provides substantially equivalent or improved peak deceleration characteristics at significantly higher static stresses. This is most significant when it is realized that the static stresses relate to the amount of foam material which is provided in contact with the object to be supported and cushioned. Accordingly, at higher static stresses, less material needs to be provided directly in contact with the object to be supported, which can thus result in a reduction in the cost of the required foam material. As noted above, such equivalent or improved peak deceleration characteristics in accordance with the present invention are believed to result from the fact that the dimensionally stable outer shell serves to maintain the integrity and configuration of the foam material. Moreover, with some objects, such as certain electronic equipment, it is not feasible or practical to increase the amount of contact area in order to provide a lower static stress. For example, with some products, the static stress cannot practically be lower than 1.0 pounds per square inch. Thus, often times conventional low density polyurethane cushion packing cannot be used in connection with such products. However, with the present invention, it is now possible to provide relatively inexpensive cushion packing for use in connection with such types of products. Still further, as illustrated in FIGS. 7–10 which include multiple drop test data, significant and more dramatic improvements in cushioning benefits for multiple drops are afforded by the cushion packings in accordance with the present invention in comparison to conventional prior art type low density foam cushion packing without an outer shell. In particular, the peak deceleration experienced by the object to be protected as the number of drops or shock loadings increases will not increase as to as great an extent as occurs with conventional low density foam cushioning packing.

Still further, as noted above, in accordance with the present invention, the dimensionally stable outer shells, which form an integral part of the cushion packings in accordance with the present invention, may be manufactured or formed at a remote location from that at which the foam material is introduced into the cavity provided thereby. This is important since it means that dimensionally stable outer shells can be produced at a single location and then transported, relatively cheaply because of the nestability feature, to another location at which the outer shells are placed in suitable, relatively inexpensive filling fixtures and the foam material introduced into the cavity and the finished cushion packings completed and subsequently used in packing objects. This can substantially reduce the processing costs associated with the present invention as it does not require thermoforming equipment at each location in which the cushion packings are produced nor does it require special thermoforming molds at each such location. Rather the thermoforming equipment and molds for forming the dimensionally stable outer shells can be provided at a single location thus reducing the overall costs associated with any packing method.

Therefore, it will be appreciated that in accordance with the present invention there is provided a cushion packing for protecting and supporting an object against shock and/or vibration which comprises a dimensionally stable outer shell forming a chamber of a predetermined desired configuration and having a foam material disposed therewithin which substantially fills and conforms to the shape of the chamber, the foam material having a molded density of less than or equal to 1.5 pounds per cubic foot. As has been noted hereinabove, such low density foam materials are generally thought to have very poor mechanical strength so as to be applicable for providing cushioning benefits at very high static stress loadings. With the present invention, however, wherein a dimensionally stable outer shell is utilized, a significant increase in static loadings, for providing equivalent or improved peak deceleration characteristics in terms of dissipation of shock or vibration loadings, can be provided.

Also in accordance with the present invention there is provided a method of packing objects comprising the steps of thermoforming a thermoformable material to form a dimensionally stable outer shell having therein a chamber of a predetermined configuration, and filling the chamber with a foam material so as to have a molded density of less than or equal to 1.5 pounds per cubic foot. Thereafter, selected ones of a plurality of such dimensionally stable shells filled with said foam material are positioned about an object to be packaged and enclosed within a selected container to thereby cushion and protect the object from shock or vibrational loadings. In accordance with an aspect of such method, the dimensionally stable outer shells can be nested together and shipped to another location where they are separated and then filled with the foam material.

While the preferred embodiments of the present invention have been shown and described, it will be understood that such are merely illustrative and that changes be made without departing from the scope of the invention as claimed.

What is claimed is:

1. A method of packing for providing low peak deceleration protection for an object, comprising the steps of:

thermoforming a thermoforming material into a flexible dimensionally stable shell of a predetermined configuration having a chamber therein, said predetermined configuration being related to the object to be packed and related to a selected container, and said dimensionally stable shell being sufficiently thin and flexible so as to transmit through said shell a substantial portion of any impact forces applied to the outer surface of said shell;

filling said chamber with a foam material in a manner such that said foam material substantially fills and conforms to the shape of said chamber and such that said foam material has a molded density of less than or equal to one and one-half pounds per cubic foot, said flexible dimensionally stable shell filled with said foam material providing a foam filled cushion packing element;

positioning said foam filled cushion packing element in said selected container; and placing said object to be packed in said container in contact with the outer surface of said dimensionally stable shell of said foam filled cushion packing element so that said object is supported and protected by said cushion packing element against shock and vibrational loads.

2. The method in accordance with claim 1, wherein said steps of thermoforming and filling are performed a plurality of times to produce a plurality of said foam filled cushion packing elements, and wherein said step of positioning comprises positioning said plurality of foam filled cushion packing elements in said selected container and said step of placing comprises placing said object in contact with said plurality of said cushion packing elements.

3. The method in accordance with claim 2, wherein said thermoforming steps are preformed at a different location from the location at which said filling steps are performed.

4. The method in accordance with claim 3, further including the steps of nesting said plurality of dimensionally stable shells to a remote location which is remote from said location at which said thermoforming steps are performed prior to execution of said filling steps, and wherein said filling, positioning and placing steps are performed at said remote location.

5. The method in accordance with claim 4, further including the steps of nesting said plurality of dimensionally stable shells prior to said shipping steps, and then separating said plurality of nested dimensionally stable shells at said remote location before execution of said filling steps.

6. The method in accordance with claim 2, wherein said step of positioning comprises adhering said plurality of cushion packing elements to selected surfaces of said container before said step of placing.

7. The method in accordance with claim 6, wherein said step of filling comprises introducing said foam material in an uncured and expandable state into said chambers in said dimensionally stable shells, and wherein said step of adhering comprises placing said shells with said uncured expandable foam material in said chambers thereof against said selected surfaces of said container before said foam material completes its expanding and curing whereby said foam material will adhere to said selected surfaces of said container.

8. The method in accordance with claim 1, wherein said step of thermoforming comprises vacuum forming said thermoformable material into said dimensionally stable shell.

9. A method of packing objects comprising the steps of:

thermoforming at a first location a thermoformable material into a plurality of dimensionally stable shells each having a chamber therein;

nesting said plurality of dimensionally stable shells together;

transporting said nested shells to a second location remote from said first location;

separating said plurality of dimensionally stable shells as needed at said second location;

filling said separated dimensionally stable shells with a foam material having a molded density of less than or equal to one and one-half pounds per cubic foot;

positioning selected ones of said plurality of dimensionally stable shells filled with said foam material about an object to be packed; and enclosing said object to be packed and said dimensionally stable shells associated therewith in a selected container.

10. A method of packing comprising the steps of:

thermoforming a thermoformable material into a dimensionally stable shell of a predetermined configuration having a chamber therein, said predetermined configuration being related to the object to be packed and related to a selected container;

filling said chamber with a foaming material so as to have a molded density of less than or equal to one and one-half pounds per cubic foot to provide a foam filled cushion packing element;

performing said thermoforming and filling steps a plurality of times to produce a plurality of foam filled cushion packing elements;

positioning said plurality of foam filled cushion packing elements in said selected container;

placing said object to be packed in contact with said plurality of said cushion packing elements so that said object is supported and protected by said cushion packing elements against shock and vibrational load and;

wherein said step of filling comprises introducing said foam material in an uncured and expandable state into said chambers in said dimensionally stable shells, and wherein said step of positioning comprises positioning said shells with said uncured expandable foam material in said chambers thereof against selected surfaces of said container before said foam material completes its expanding and curing to thereby adhere said plurality of said cushion packing elements to said selected surfaces of said container.

* * * * *

UNITED STATES PATENT AND TRADEMARK OFFICE

CERTIFICATE OF CORRECTION

PATENT NO. : 4,584,822

DATED : April 29, 1986

INVENTOR(S) : Fielding et al

It is certified that error appears in the above-identified patent and that said Letters Patent is hereby corrected as shown below:

Column 5, line 21, "2,997,639" should read --2,977,639--.
Column 10, line 46, before "for", insert --utilized--.
Column 23, line 5, "steps" should read --step--; delete "nesting" and insert therefor --shipping--.

Signed and Sealed this

Seventh Day of April, 1987

*Attest:*

*Attesting Officer*

DONALD J. QUIGG

*Commissioner of Patents and Trademarks*